US009481917B2

(12) United States Patent
Bochiechio et al.

(10) Patent No.: US 9,481,917 B2
(45) Date of Patent: Nov. 1, 2016

(54) GASEOUS BASED DESULFURIZATION OF ALLOYS

(71) Applicant: United Technologies Corporation, Hartford, CT (US)

(72) Inventors: Mario P. Bochiechio, Vernon, CT (US); John Joseph Marcin, Marlborough, CT (US); Kirk C. Newton, Enfield, CT (US); Michael A. Kmetz, Colchester, CT (US)

(73) Assignee: United Technologies Corporation, Farmington, CT (US)

( * ) Notice: Subject to any disclaimer, the term of this patent is extended or adjusted under 35 U.S.C. 154(b) by 741 days.

(21) Appl. No.: 13/723,081

(22) Filed: Dec. 20, 2012

(65) Prior Publication Data

US 2014/0178244 A1 Jun. 26, 2014

(51) Int. Cl.
*C22B 9/05* (2006.01)
*B22D 1/00* (2006.01)

(52) U.S. Cl.
CPC *C22B 9/05* (2013.01); *B22D 1/002* (2013.01)

(58) Field of Classification Search
CPC ..... C22B 9/05; B22D 1/002
See application file for complete search history.

(56) References Cited

U.S. PATENT DOCUMENTS 4,097,269 A * 6/1978 Holzgruber ..... C21C 7/064 75/10.17
4,159,906 A * 7/1979 Meichsner ..... C21C 1/025 75/307
4,198,229 A * 4/1980 Katayama ..... C22B 9/10 420/34
4,895,201 A 1/1990 DeCrescente et al.
5,242,480 A * 9/1993 Rebiere ..... C22B 1/244 75/312
5,322,813 A * 6/1994 Beach ..... H01L 31/0288 117/88
5,335,717 A 8/1994 Chin et al.
5,358,578 A * 10/1994 Tischhauser ..... C21D 8/08 148/328
5,364,563 A 11/1994 Cathrein et al.
5,504,789 A 4/1996 Lew et al.
5,922,148 A * 7/1999 Irvine ..... C21C 7/064 148/555
6,024,163 A 2/2000 Springgate et al.
6,379,425 B1 * 4/2002 Kikuchi ..... C21C 7/0645 75/529

(Continued)

FOREIGN PATENT DOCUMENTS

CN 101736131 B * 6/2012
DE 2708522 A1 8/1978

(Continued)

OTHER PUBLICATIONS

Georg Härtel et al. Removal of Sulfur-Containing Pollutants From Product and Waste Gases and Reduction of Oxides of Sulfur and Oxides of Nitrogen in Flue Gases Chemie Ingenieur Technik (1986), 58(4), 340-1, Coden: Citeah, ISSN: 0009-286X.*

(Continued)

*Primary Examiner* — Jessee Roe
*Assistant Examiner* — Jenny Wu
(74) *Attorney, Agent, or Firm* — Kinney & Lange, P.A.

(57) ABSTRACT

A method for desulfurizing a metal alloy comprises heating the metal alloy to a molten state. A gaseous desulfurizing compound is bubbled through the molten alloy to form a solid sulfur-containing waste phase and a molten reduced-sulfur alloy phase. The solid waste phase and the molten reduced-sulfur alloy phase are separated. The gaseous desulfurizing compound includes a constituent element selected from the group: alkali metals, alkaline earth metals, and rare earth metals.

22 Claims, 2 Drawing Sheets

(56) References Cited

U.S. PATENT DOCUMENTS

| | | | | |
|---|---|---|---|---|
| 6,500,283 | B1 | 12/2002 | Schaeffer et al. | |
| 2006/0021467 | A1 | 2/2006 | Zebrowski | |
| 2014/0134353 | A1* | 5/2014 | Mittendorf ..... | C22C 19/03 427/597 |

FOREIGN PATENT DOCUMENTS

| | | | |
|---|---|---|---|
| EP | 0724018 | A1 | 7/1996 |
| EP | 0860507 | A1 | 8/1998 |
| JP | 6187815 | A | 5/1986 |
| JP | 11199913 | A | 7/1999 |
| JP | 2012172205 | A | 9/2012 |
| WO | WO2012095471 | A2 | 7/2012 |

OTHER PUBLICATIONS

Molbase.*
Scifinder.*
International Search Report and Written Opinion, dated Apr. 8, 2014, for PCT Application No. PCT/US2013/075467, 13 pages.
Extended European Search Report for European Patent Application No. 13865452.0, dated May 12, 2016, 9 pages.

* cited by examiner

GASEOUS BASED DESULFURIZATION OF ALLOYS

BACKGROUND

The described subject matter relates generally to metal alloys and more specifically to preparation of low sulfur alloys.

Sulfur has always been difficult to remove from many alloys, and can accelerate oxidation, particularly in high temperature environments such as turbine engines. Superalloys are conventionally desulfurized using ceramic based powders including calcium oxide (CaO), magnesium oxide (MgO), or calcium magnesium carbonate ($CaMg(CO_3)_2$), known as dolomite. Calcium and magnesium metal also have been used but have well-known handling issues.

Large quantities of these substances are required in order to maintain a desulfurization reaction at very low sulfur concentrations. The resulting ceramic byproducts are high in oxide content, making them difficult to remove, which complicates subsequent solidification, and reduces product quality.

SUMMARY

A method for desulfurizing a metal alloy comprises heating the metal alloy to a molten state. A gaseous desulfurizing compound is bubbled through the molten alloy to form a solid sulfur-containing waste phase and a molten reduced-sulfur alloy phase. The solid sulfur-containing waste phase and the molten reduced-sulfur alloy phase are separated. The gaseous desulfurizing compound includes a constituent element selected from the group: alkali metals, alkaline earth metals, and rare earth metals.

A method for casting an article comprises introducing a gaseous desulfurizing compound into a casting vessel containing a molten alloy. The gaseous desulfurizing compound is bubbled through the molten alloy to form a solid sulfur-containing waste phase and a molten reduced-sulfur alloy phase. The solid waste phase and the molten reduced-sulfur alloy phase are separated. The molten reduced-sulfur phase alloy is solidified to form the cast article. The gaseous desulfurizing compound includes a constituent element selected from the group: alkali metals, alkaline earth metals, and rare earth metals.

DETAILED DESCRIPTION

Figure 1:
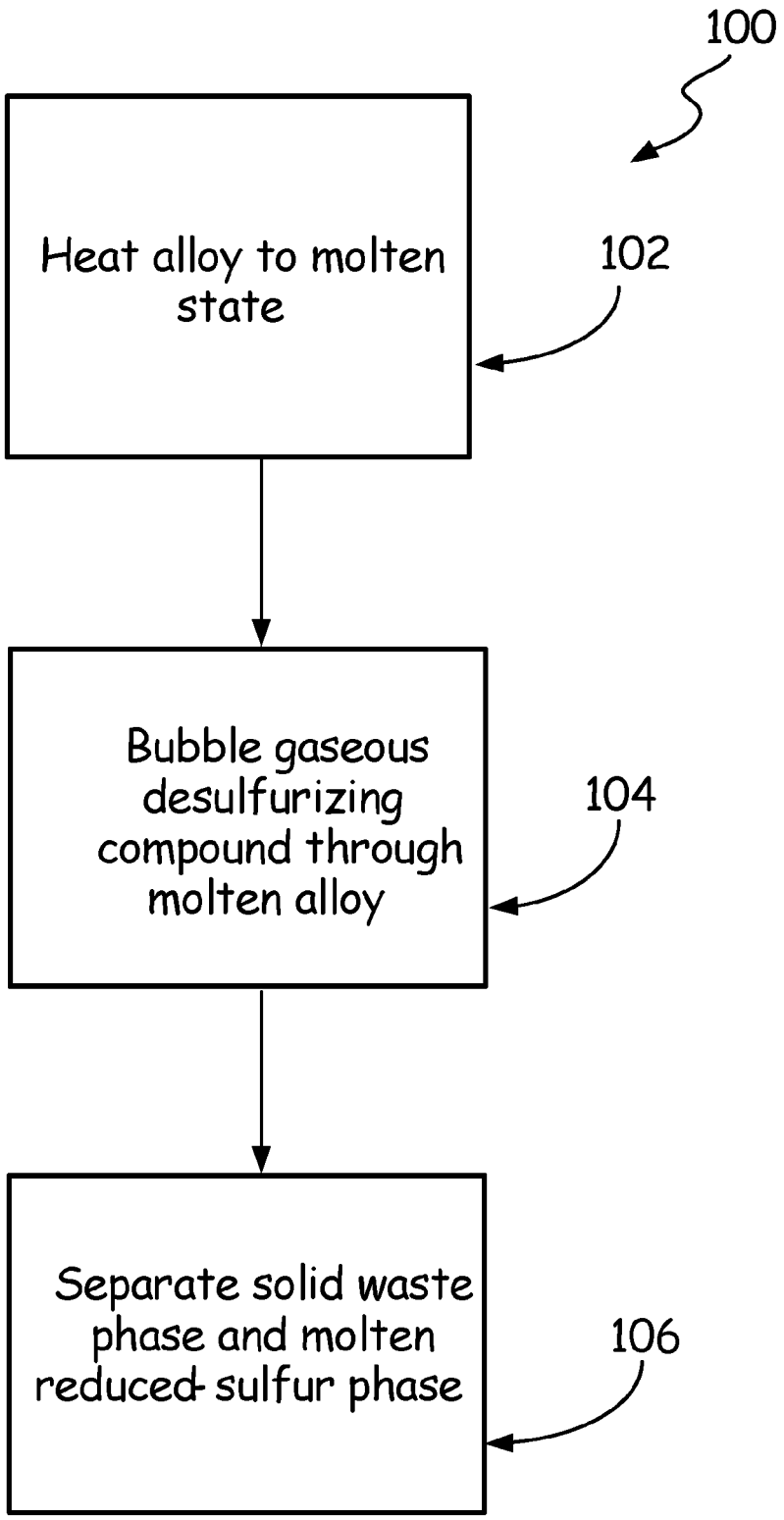
FIG. 1 shows steps of an example method for desulfurizing a metal alloy.

FIG. 1 shows steps of an example method for desulfurizing a metal alloy. At step 102, a metal alloy is heated to a molten state. Step 102 can include forming an initial melt from a variety of raw ingredients. Alternatively, the heating step can include remelting some or all of an existing alloy system. During melting or remelting of the alloy into a molten state, additional alloying elements can be added to tailor properties of the alloy for the finished article. The melting step can be performed by any apparatus suitable for the particular alloy. Non-limiting examples include an electric arc furnace and/or a vacuum induction melting furnace. Melting a superalloy using a vacuum induction furnace prevents excessive oxidation and slag formation. However, the system may be backfilled with an inert atmosphere such as argon to prevent the volatilization of certain elements with high vapor pressures at elevated temperatures.

In certain embodiments, the metal alloy is a superalloy comprising at least about 45% nickel, or at least about 45% cobalt. Several non-limiting example superalloys include those containing primarily nickel. Certain embodiments of nickel-based superalloys include various quantities of one or more alloying elements such as: chromium, cobalt, molybdenum, aluminum, magnesium, tungsten, tantalum, hafnium, rhenium, yttrium, lanthanum, erbium, and cerium. While the example is described with respect to superalloys it will be recognized that the processed can be adapted to removing sulfur from many other types of alloys as well.

Embodiments of the described desulfurization process can be adapted for ultra-low sulfur versions of a number of existing alloys, as well as new alloys. The process can also be used in conjunction with, or in place of, known bulk desulfurization processes. Non-limiting examples of existing alloys and bulk desulfurization processes are described in commonly assigned U.S. Pat. Nos. 4,719,080; 5,344,510; 5,346,563; 5,540,789; and 6,007,645.

Raw ingredients used in many alloys can contain at least some quantities of sulfur. Problems caused by sulfur are well known, and include accelerated oxidation and weakened microstructures. When selecting raw materials, their sulfur content can be reduced either through the acquisition of low sulfur content materials or through secondary processing prior to introduction into the alloy. These and other steps can be taken in conjunction with the gaseous desulfurization process to minimize accumulation of sulfur from all components that comprise the final alloy system.

Step 104 includes bubbling a gaseous desulfurizing compound through the molten alloy. This can be done, for example, by inserting a lance into the molten alloy which carries the gaseous desulfurizing compound. Generally speaking, the compound reacts with sulfur contained in the molten alloy, resulting in a solid sulfur-containing waste phase and a molten reduced-sulfur alloy phase. The gaseous desulfurizing compound can include a constituent element selected from the group: alkali metals, alkaline earth metals and rare earth metals. Rare earth metals include elements in the lanthanide series, as well as yttrium (Y) and scandium (Sc).

This sulfur-containing waste phase segregates out as slag from the initial molten alloy from step 102 to leave behind a molten reduced-sulfur alloy phase. Bubbling step 104 can cause a reaction with sulfur in the molten alloy system so as to create a waste or slag byproduct that can be more easily removed as compared to slag and dross from traditional oxide-based processes. While not intending to be bound by a particular theory, it is believed that gases such as those described herein selectively react with the sulfur in the molten alloy to produce slag particles with relatively low shares of polarized oxygen bonds.

Previous attempts to remove sulfur are generally based on adding a ceramic oxide or a pure metal that selectively reacts with sulfur in the alloy while in the molten state. However, there are challenges associated with filtering these byproducts as well as excess quantities of the oxide necessary to achieve extremely low sulfur concentrations. Residual oxide or dross that remains in the alloy can also cause problems and scrap later in the process as described below.

Further, bubbling a desulfurizing gas through the alloy increases contact area and contact time with the alloy. Since oxide ceramics such as CaO, MgO, or dolomite are not miscible in many molten superalloys, a substantial amount of energy is consumed to create sufficient inductive mixing to agitate the alloy and adequately incorporate the selected oxide which facilitates the desulfurization reaction. Much of this energy is converted to heat as a result of the inductive stirring. Increased alloy temperatures will further accelerate erosion of refractory vessel linings, adding even more slag and dross. The act of agitating the molten alloy can also result in unwanted evaporation of aluminum, chromium, and other alloying elements from the system just prior to casting an article. Loss of alloying metals in this way must be accounted for in the alloy composition, and results in additional waste and process variation.

Slag particles resulting from oxide ceramic compounds appear to have an affinity for one another as well as for the refractory materials existing throughout molten alloy handling systems, such as the crucible and the filters. As excess quantities of oxide ceramics are required to react with the sulfur in the molten alloy system, there is a significant increase in ceramic waste particles that readily adhere to refractory surfaces such as the casting vessel, crucible, and filters. The slag particles resulting from oxide ceramic desulfurization may also combine with refractory material eroded away from vessel linings and other structures. The increased slag volume can be very difficult to remove from the system prior to or during casting. In larger quantities, the ceramic oxide slag particles and eroded refractory material agglomerate to form a dam, which blocks the flow of the molten alloy from the storage or casting vessel. In one example, slag resulting from oxide ceramic desulfurization can form a dam blocking flow from the casting crucible to the ingot tubes, which can result in missed pours and aborted runs. Additionally, excess unreacted oxides can quickly combine with the other waste, clogging the inline filter system that is normally utilized. While pouring a standard (non-desulfurized) alloy, this type of filter setup is effective at removing a significant portion of the dross and slag from the system. However, for extremely low sulfur alloy formulations, significant changes to the tundish and filters need to be made when they are being used with excess oxide so as to prevent blockages, spillage, and missed pours to the ingot tubes. These changes are not usually required with the present gaseous based processes.

The gaseous desulfurizing compound can comprise one or more desulfurizing gases and/or vaporized precursor compounds. Each compound can have a chemical composition with a constituent element selected from the group: alkali metals, alkaline earth metals and rare earth metals. In certain of these embodiments, the constituent element in each compound is selected from the group: calcium (Ca), magnesium (Mg), yttrium (Y), lanthanum (La), erbium (Er), and cerium (Ce). The constituent element in each compound is in a reactive form for binding with sulfur in the molten alloy system, resulting in waste particles that are more easily removable as compared to the slag and dross resulting from prior oxide-based desulfurization.

In certain embodiments, gases can be evolved or otherwise derived from decomposition of precursor compounds containing the constituent elements, such as metal organic complexes and/or hydrates of metal halide salts. These precursor compounds are typically solid at room temperature, but can be heated, for example, to about 150° C. (about 300° F.) to about 300° C. (about 575° F.) to form a liquid precursor that can be dispensed in controlled quantities via a liquid metering system and/or atomized into a carrier gas before entering the alloy. Liquid- and/or vapor-phase precursor compound(s) are carried into the process and can be fully vaporized prior to entering the lance by supplemental heating if needed. The compound(s) begin the decomposition process that will be carried to completion in the molten alloy.

One candidate for the constituent element is Ca, which is not usually beneficial to superalloy performance. However, calcium has a relatively high vapor pressure, and is highly reactive with sulfur to produce reaction byproducts, such as calcium sulfide, that can be removed easily from the molten alloy through filtering the slag. Thus, in these embodiments, very minimal quantities of reactive calcium remain in the molten alloy solution after performing bubbling step 104. Non-limiting examples of suitable calcium-containing precursor compounds include hydrates of calcium chloride [$CaCl_2$] salt. The hydrate precursor is heated to derive vapor-phase $CaCl_2$. Additional non-limiting examples of calcium-containing desulfurizing gases can be derived from decomposition byproducts of vapor-phase calcium-containing metal organic complexes. Example precursors include calcium dipivaloylmethanate [$Ca(C_{11}H_{19}O_2)_2)$]; bis(hexafluoro-acetylacetonate) calcium (II), [$Ca(C_5HF_6O_2)_2)$]; bis(2,2-dimethyl-,6,6,7,7,8,8,8-heptafluoro-3,5-octanedione) calcium (II), [$Ca(C_{10}H_{10}F_7O_2)_2$]; bis(1,1,1-trifluoro-2,4-pentanedionato) calcium (II), [$Ca(F_3C(C{=}O)CH_2(C{=}O)CH_3)_2$]; and (1,1,1,5,5,5-hexafluoro-2,4-pentanedionato) calcium (II), [$Ca(F_3C(C{=}O)CH_2(C{=}O)CF_3)_2$].

In certain alternative embodiments, a portion of the constituent element(s) undergo a reduction reaction and remain in the alloy system. As such, the constituent elements in certain embodiments may be selected to be compatible with desired alloy properties such as grain size control, and resistance to creep, oxidation, and fatigue cracking. One example of such a constituent element is Mg, which generally improves mechanical properties as well as fatigue and creep resistance in superalloys.

The gaseous desulfurizing compound in these embodiments can be derived for example by vaporizing hydrates of magnesium chloride salt to release vapor-phase $MgCl_2$. Additional non-limiting examples of magnesium-containing desulfurizing gases can be derived from decomposition byproducts of vapor-phase metal organic complexes, such as magnesium dipivaloylmethanate [$Mg(C_{11}H_{19}O_2)_2)$]; bis(hexafluoro-acetylacetonate) magnesium (II), [$Mg(C_5HF_6O_2)_2)$]; bis(2,2-dimethyl-,6,6,7,7,8,8,8-heptafluoro-3,5-octanedione) magnesium (II), [$Mg(C_{10}H_{10}F_7O_2)_2$]; bis(1,1,1-trifluoro-2,4-pentanedionato) magnesium (II), [$Mg(F_3C(C{=}O)CH_2(C{=}O)CH_3)_2$]; and (1,1,1,5,5,5-hexafluoro-2,4-pentanedionato) magnesium (II), [$Mg(F_3C(C{=}O)CH_2(C{=}O)CF_3)_2$].

In certain alternative embodiments, complexes of rare earth metals including Y, La, Er, and Ce can also be vaporized and decomposed to produce desulfurization gases. As above, the precursor compound can be heated and injected into the alloy, where the gaseous compound releases the reactive constituent element into the melt which reacts with and segregates out sulfur. Example compounds from this family of precursors include tris(cyclopentadienyl)RE (III), where RE is a rare earth metal. One example is the yttrium variant tris(cyclopentadienyl)Y(III), [$Y(C_5H_5)_3$]. Another example family of precursor compounds includes tris[N,N-bis(trimethylsilyl)amide]RE(III), where RE is a rare earth metal. This can be lanthanum version tris[N,N-bis(trimethylsilyl)amide] lanthanum(III), [$La(N(Si(CH_3)_3)_2)_3$]. Yet another example family of precursor compounds includes tris(2,2,6,6-tetramethyl-3,5-heptanedionate)RE(III). One non-limiting example of this family includes tris(2,2,6,6-tetramethyl-3,5-heptanedionate) erbium(III) [$Er(OCC(CH_3)_3CHCOC(CH_3)_3)_3$)].

When applicable, some of the desirable metal ions that are suitable for desulfurization can be directly vaporized from their highly refined metallic states. Melting and boiling points of elements such as Mg and Ca which are below the superalloy can be utilized to create a direct metal vapor that can be used in the same fashion as the above mentioned gases.

It will be recognized that bubbling step 104 can be performed either by continuously or periodically bubbling the compound through the molten alloy. Bubbling step 104 can be performed until reaching the desired sulfur content in the reduced sulfur molten alloy phase. In certain embodiments, bubbling step 104 can be performed until the reduced sulfur molten phase comprises less than about 0.00025 wt % S. In certain of those embodiments, bubbling step 104 can be performed until the reduced sulfur molten phase comprises less than about 0.00015 wt % S. In yet certain of those embodiments, bubbling step 104 can be performed until the reduced sulfur molten phase contains less than about 0.00010 wt % S.

Step 106 describes separating the newly formed solid phase and the molten reduced-sulfur alloy phase. As described above, gaseous desulfurizing compound(s) result in a solid waste phase consisting mainly of discrete particles that are less prone to congealing and blocking refractory surfaces in the molten alloy handling system. As such, step 106 can be performed after the gaseous compound has been run through the molten alloy, with the resulting solid waste by-products easily filtered out of the system through simple "skim" or inline filters.

Bubbling step 104 is described generally as using a gaseous desulfurizing compound. The gaseous desulfurizing compound includes the vapor phase of the precursor compound(s) as well as any transitional compounds formed prior to the sulfur reaction in the melt. While one or more gaseous compounds may be applied simultaneously, it will be recognized that the gases can alternatively be applied sequentially to the molten alloy. Certain embodiments include multiple instances of bubbling step 104 being performed in an alternating manner with one or more instances of separating step 106. For example, a first desulfurization compound may be bubbled through the molten alloy, which is then filtered according to step 106. In one example, a second desulfurization compound may then be applied subsequent to the first instance of filtering, with a second instance of filtering following bubbling of the second desulfurization compound.

It will also be recognized that steps of the above desulfurizing process can be performed prior to, or in conjunction with a solidification process. For example, in certain embodiments, the desulfurizing and filtering apparatus can be incorporated directly into a molten alloy processing system, such as a casting system.

Figure 2:
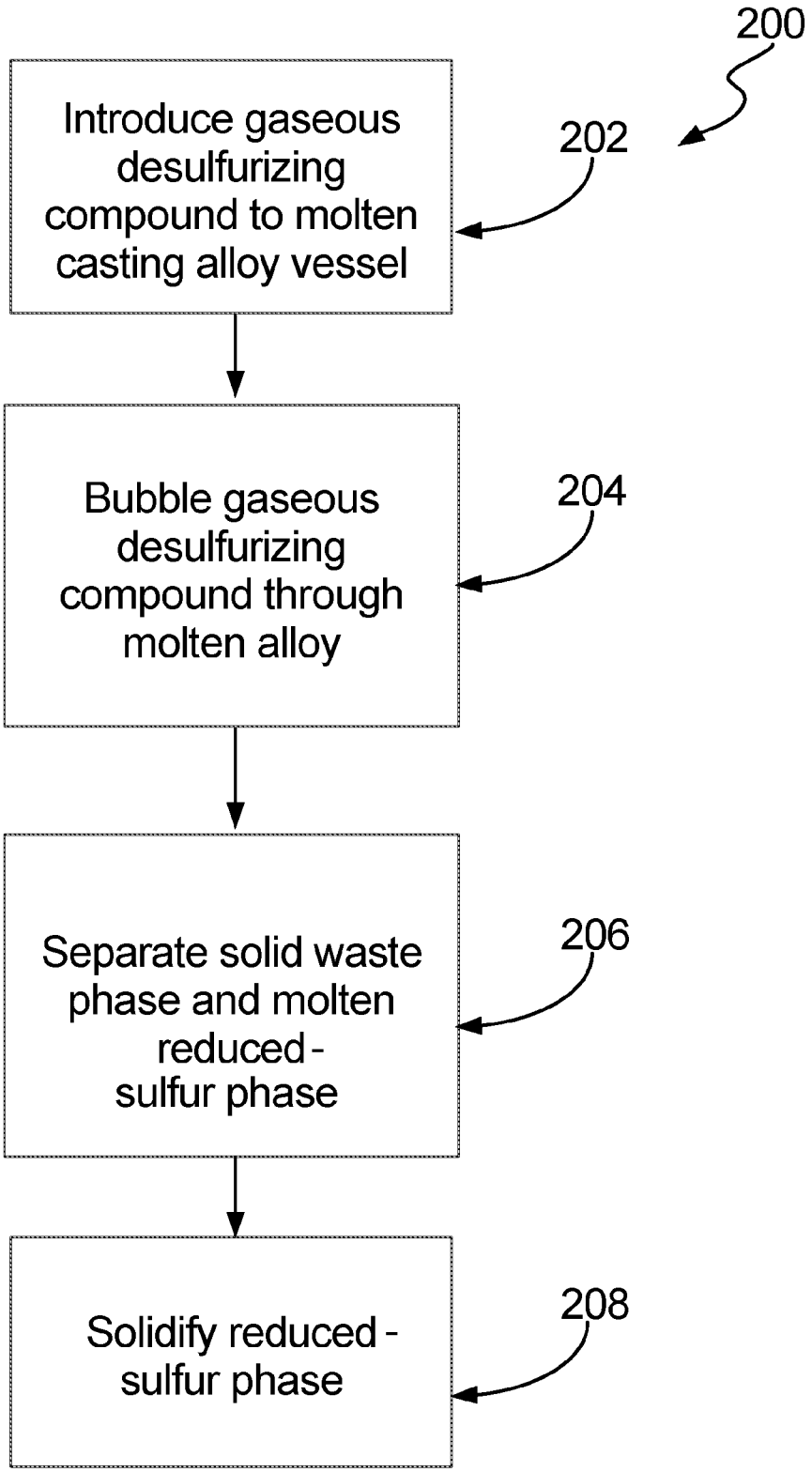
FIG. 2 depicts an example method for casting a reduced-sulfur metal article.

FIG. 2 depicts steps of a method 200 for casting an article which can have reduced sulfur content. Step 202 includes introducing a gaseous desulfurizing compound into a vessel containing a molten casting alloy. The molten alloy can be heated according to any of the methods described above with respect to step 102 shown in FIG. 1. The vessel may be a refractory storage or heating vessel, such as a casting crucible. The gaseous compound may be introduced by inserting a gas feed line or lance into the alloy. Alternatively, the vessel itself can be modified with ports, valves, and fittings so as to allow the gas to be introduced from below.

At step 204, the gaseous desulfurizing compound(s) can be bubbled through the alloy in the vessel to form a solid sulfur-containing waste phase and a molten reduced-sulfur alloy phase. As above, the gaseous desulfurizing compound can include at least one constituent element selected from the group: alkali metals, alkaline earth metals, and rare earth metals. This results in a desulfurization reaction leaving behind easily removable solid waste particles as noted above.

The sulfur-containing waste phase can then be removed from the molten reduced-sulfur alloy phase (step 206), then solidified (step 208). As previously described, the solid waste particles may be simply skimmed. Additionally or alternatively, the molten reduced-sulfur alloy system may be run through an inline filter disposed between the vessel and the inlet of a casting mold or other vessel. At solidification step 208, the alloy can be cast into ingots, or can also include other conventional and novel solidification methods, including but not limited to equiax, directional, or single-crystal solidification.

Many casting molds are provided with a sacrificial region beyond desired dimensions of the cast article. The solidification process can be controlled so as to segregate the various defects, dross, shrinkage, etc. into this region. Since byproducts of the gaseous desulfurization reaction are more easily removed as compared to previous oxide-based desulfurization processes, fewer defects and dross actually reach the casting mold. This can enable use of a smaller sacrificial region resulting in smaller molds and less waste. In addition, reducing sulfur concentrations in this manner is more likely to result in fewer inclusion-related defects found in the final casting, which increases the life and performance of the final product as well as increasing acceptance rates.

A non-limiting example of a casting process will illustrate how the gaseous desulfurization compound can be incorporated. (1) Raw materials with alloying elements are added to a crucible. These materials may have relatively low initial sulfur content as described above. (2) A vacuum is drawn on the chamber of a vacuum induction furnace. The chamber may be optionally backfilled with an inert gas such as argon to reduce vaporization of certain alloying elements. (3) Current is applied to the induction coil to begin melting the elements. (4) System temperature is stabilized once a molten state is reached. (5) The molten metal is lanced with a tube by which the gaseous desulfurizing compound(s) may be flown through. (6) The compound is introduced and passed through the molten alloy for a sufficient duration, forming the solid sulfur-containing waste phase and the molten reduced-sulfur alloy phase. (7) The lance is removed, and the molten alloy system stabilized. (8) The solid sulfur-containing waste phase and the molten reduced-sulfur phase are transferred to a tundish to filter the waste (slag and dross) leaving the molten reduced-sulfur alloy. (9) The molten reduced-sulfur alloy is delivered to ingot tubes. Alternatively, for controlled microstructure castings, the alloy can be poured into a mold or die. (10) Once poured, the desulfurized alloy can be solidified to cast an ingot. Alternatively, the casting may be an equiaxed, directionally solidified, or single crystal article.

The subject matter was described with reference to desulfurizing and casting of superalloys. While superalloys are traditionally investment cast, it will be recognized that various alternative embodiments can be adapted to include other conventional or novel casting processes such as high temperature die casting. It will also be appreciated that various embodiments can be adapted to reduce sulfur content of other conventional or novel casting alloys.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present disclosure.

A method for desulfurizing a metal alloy comprises heating the metal alloy to a molten state. A gaseous desulfurizing compound is bubbled through the molten alloy to form a solid sulfur-containing waste phase and a molten reduced-sulfur alloy phase.

The method of the preceding paragraph can optionally include, additionally and/or alternatively, any one or more of the following features, configurations and/or additional components:

A method according to an exemplary embodiment of this disclosure, among other possible things, includes heating the metal alloy to a molten state. A gaseous desulfurizing compound is bubbled through the molten alloy to form a solid sulfur-containing waste phase and a molten reduced-sulfur alloy phase. The gaseous desulfurizing compound includes a constituent element selected from the group: alkali metals, alkaline earth metals, and rare earth metals. The solid sulfur-containing waste phase and the molten reduced-sulfur alloy phase are separated.

A further embodiment of the foregoing method, wherein the metal alloy is additionally and/or alternatively a nickel-based superalloy or a cobalt-based superalloy.

A further embodiment of any of the foregoing methods, wherein the constituent element is additionally and/or alternatively selected from the group: Ca, Mg, Y, La, Er, and Ce.

A further embodiment of any of the foregoing methods, wherein the gaseous desulfurizing compound is additionally and/or alternatively derived from a precursor compound comprising at least one of: hydrates of a metal halide salt, and a metal organic complex (MOC).

A further embodiment of any of the foregoing methods, wherein additionally and/or alternatively, the constituent element is Ca.

A further embodiment of any of the foregoing methods, wherein the precursor compound is additionally and/or alternatively selected from the group: calcium chloride [$CaCl_2$]; calcium dipivaloylmethanate [$Ca(C_{11}H_{19}O_2)_2$)]; bis(hexafluoro-acetylacetonate) calcium (II), [$Ca(C_5HF_6O_2)_2$)]; bis(2,2-dimethyl-,6,6,7,7,8,8,8 -heptafluoro-3,5-octanedione) calcium (II), [$Ca(C_{10}H_{10}F_7O_2)_2$]; bis(1,1,1-trifluoro-2,4-pentanedionato) calcium (II), [$Ca(F_3C(C{=}O)CH_2(C{=}O)CH_3)_2$]; and (1,1,1,5,5,5-hexafluoro-2,4-pentanedionato) calcium (II), [$Ca(F_3C(C{=}O)CH_2(C{=}O)CF_3)_2$]; and mixtures thereof.

A further embodiment of any of the foregoing methods, wherein additionally and/or alternatively, the constituent element is Mg.

A further embodiment of any of the foregoing methods, wherein the precursor compound is selected from the group: magnesium chloride [$MgCl_2$]; magnesium dipivaloylmethanate [$Mg(C_{11}H_{19}O_2)_2$)]; bis(hexafluoro-acetylacetonate) magnesium (II), [$Mg\ (C_5HF_6O_2)_2$)]; bis(2,2-dimethyl-,6,6,7,7,8,8,8-heptafluoro-3,5-octanedione) magnesium (II), [$Mg\ (C_{10}H_{10}F_7O_2)_2$]; bis(1,1,1-trifluoro-2,4-pentanedionato) magnesium (II), [$Mg(F_3C(C{=}O)CH_2(C{=}O)CH_3)_2$]; and (1,1,1,5,5,5-hexafluoro-2,4-pentanedionato) magnesium (II), [$Mg(F_3C(C{=}O)CH_2(C{=}O)CF_3)_2$]; and mixtures thereof.

A further embodiment of any of the foregoing methods, wherein the precursor compound is additionally and/or alternatively a metal organic complex belonging to a family of tris(cyclopertadienyl)RE(III) compounds, where RE is a rare earth metal.

A further embodiment of any of the foregoing methods, wherein the metal organic complex additionally and/or alternatively comprises tris(cyclopertadienyl) yttrium(III), [$Y(C_5H_5)_3$].

A further embodiment of any of the foregoing methods, wherein the precursor compound additionally and/or alternatively is a metal organic complex belonging to a family of tris[N,N-bis(trimethylsilyl)amide]RE(III) compounds, where RE is a rare earth metal.

A further embodiment of any of the foregoing methods, wherein the metal organic complex additionally and/or alternatively comprises tris[N,N-bis(trimethylsilyl)amide] lanthanum(III), [$La(N(Si(CH_3)_3)_2)_3$].

A further embodiment of any of the foregoing methods, wherein the precursor compound additionally and/or alternatively is a metal organic complex belonging to a family of tris(2,2,6,6-tetramethyl-3,5-heptanedionate)RE(III) compounds, where RE is a rare earth metal.

A further embodiment of any of the foregoing methods, wherein the metal organic complex additionally and/or alternatively comprises tris(2,2,6,6-tetramethyl-3,5-heptanedionate) erbium(III), [$Er(OCC(CH_3)_3CHCOC(CH_3)_3)_3$].

A further embodiment of any of the foregoing methods, wherein the bubbling step is additionally and/or alternatively performed until the reduced sulfur molten phase comprises less than about 0.00025 wt % S.

A further embodiment of any of the foregoing methods, wherein the bubbling step is additionally and/or alternatively performed until the reduced sulfur molten phase comprises less than about 0.00010 wt % S.

A further embodiment of any of the foregoing methods, wherein the gaseous desulfurizing compound additionally and/or alternatively includes a plurality of desulfurizing gases, each desulfurizing gas having a constituent element selected from the group: alkali metals, alkaline earth metals, and rare earth metals.

A method for casting an article comprises introducing a gaseous desulfurizing compound into a casting vessel containing a molten alloy. A gaseous desulfurizing compound is bubbled through the molten alloy to form a solid sulfur-containing waste phase and a molten reduced-sulfur alloy phase. The gaseous desulfurizing compound includes a constituent element selected from the group: alkali metals, alkaline earth metals, and rare earth metals.

The method of the preceding paragraph can optionally include, additionally and/or alternatively, any one or more of the following features, configurations and/or additional components:

A method according to an exemplary embodiment of this disclosure, among other possible things, includes introducing a gaseous desulfurizing compound into a casting vessel containing a molten alloy. The gaseous desulfurizing compound is bubbled through the molten alloy to form a solid sulfur-containing waste phase and a molten reduced-sulfur alloy phase. The solid waste phase and the molten reduced-sulfur alloy phase are separated. At least a portion of the molten reduced-sulfur alloy is solidified to form the cast article. The gaseous desulfurizing compound includes a constituent element selected from the group: alkali metals, alkaline earth metals, and rare earth metals.

A further embodiment of the foregoing method wherein the metal alloy additionally and/or alternatively is a nickel-based superalloy or a cobalt-based superalloy.

A further embodiment of any of the foregoing methods, wherein the constituent element additionally and/or alternatively is at least one of: Ca, Mg, Y, La, Er, and Ce.

A further embodiment of any of the foregoing methods, wherein additionally and/or alternatively, the constituent element is Ca.

A further embodiment of any of the foregoing methods, wherein additionally and/or alternatively, the constituent element is Mg.

A further embodiment of any of the foregoing methods, wherein additionally and/or alternatively, the gaseous desulfurizing compound is derived from a precursor compound comprising a metal organic complex (MOC).

A further embodiment of any of the foregoing methods, wherein the metal organic complex additionally and/or alternatively is a member of a family of tris(cyclopertadienyl)RE(III) compounds, where RE is a rare earth metal.

A further embodiment of any of the foregoing methods, wherein the metal organic complex additionally and/or alternatively is a member of a family of tris[N,N-bis(trimethylsilyl)amide]RE(III) compounds, where RE is a rare earth metal.

A further embodiment of any of the foregoing methods, wherein the metal organic complex is a member of a family of tris(2,2,6,6-tetramethyl-3,5-heptanedionate)RE(III) compounds, where RE is a rare earth metal.

A cast article can be made according to any of the foregoing methods.

A further embodiment of the foregoing cast article additionally and/or alternatively comprising less than about 0.00015 wt % S.

A further embodiment of any of the foregoing cast articles additionally and/or alternatively comprising less than about 0.00010 wt % S.

A further embodiment of any of the foregoing cast articles additionally and/or alternatively comprising at least one directionally solidified crystal.

The invention claimed is:

1. A method for desulfurizing a metal alloy, the method comprising:

heating the metal alloy to a molten state;

heating a precursor compound comprising a metal organic complex (MOC) to decompose at least the MOC into a gaseous desulfurizing compound including a constituent element selected from a group consisting of: alkali metals, alkaline earth metals, and rare earth metals;

bubbling the gaseous desulfurizing compound through the molten alloy to form a solid sulfur-containing waste phase and a molten reduced-sulfur alloy phase, at least the constituent element reacting with sulfur in the molten alloy to form at least a portion of the solid sulfur-containing waste phase; and separating the solid sulfur-containing waste phase and the molten reduced-sulfur alloy phase.

2. The method of claim 1, wherein the metal alloy is a nickel-based superalloy or a cobalt-based superalloy.

3. The method of claim 1, wherein the constituent element is selected from a group consisting of: Ca, Mg, Y, La, Er, and Ce.

4. The method of claim 3, wherein the constituent element is Ca and the precursor compound is selected from a group consisting of: calcium dipivaloylmethanate [$Ca(C_{11}H_{19}O_2)_2)$]; bis(hexafluoro-acetylacetonate) calcium (II), [$Ca(C_5HF_6O_2)_2)$]; bis(2,2-dimethyl-,6,6,7,7,8,8,8-heptafluoro-3,5-octanedione) calcium (II), [$Ca(C_{10}H_{10}F_7O_2)_2$]; bis(1,1,1-trifluoro-2,4-pentanedionato) calcium (II), [$Ca(F_3C(C{=}O)CH_2(C{=}O)CH_3)_2$]; and (1,1,1,5,5,5-hexafluoro-2,4-pentanedionato) calcium (II), [$Ca(F_3C(C{=}O)CH_2(C{=}O)CF_3)_2$]; and mixtures thereof.

5. The method of claim 3, wherein the constituent element is Mg and the precursor compound is selected from a group consisting of: magnesium dipivaloylmethanate [$Mg(C_{11}H_{19}O_2)_2)$]; bis(hexafluoro-acetylacetonate) magnesium (II), [$Mg(C_5HF_6O_2)_2)$]; bis(2,2-dimethyl-,6,6,7,7,8,8,8-heptafluoro-3,5-octanedione) magnesium (II), [$Mg(C_{10}H_{10}F_7O_2)_2$]; bis(1,1,1-trifluoro-2,4-pentanedionato) magnesium (II), [$Mg(F_3C(C{=}O)CH_2(C{=}O)CH_3)_2$]; and (1,1,1,5,5,5-hexafluoro-2,4-pentanedionato) magnesium (II), [$Mg(F_3C(C{=}O)CH_2(C{=}O)CF_3)_2$]; and mixtures thereof.

6. The method of claim 1, wherein the metal organic complex belongs to a family of tris(cyclopertadienyl)RE(III) compounds, where RE is a rare earth metal.

7. The method of claim 6, wherein the metal organic complex comprises tris(cyclopertadienyl) yttrium(III), [$Y(C_5H_5)_3$].

8. The method of claim 1, wherein the metal organic complex belongs to a family of tris[N,N-bis(trimethylsilyl) amide]RE(III) compounds, where RE is a rare earth metal.

9. The method of claim 8, wherein the metal organic complex comprises tris[N,N-bis(trimethylsilyl)amide] lanthanum(III), [$La(N(Si(CH_3)_3)_2)_3$].

10. The method of claim 1, wherein the metal organic complex belongs to a family of tris(2,2,6,6-tetramethyl-3,5-heptanedionate)RE(III) compounds, where RE is a rare earth metal.

11. The method of claim 10, wherein the metal organic complex comprises tris(2,2,6,6-tetramethyl-3,5-heptanedionate) erbium(III), [$Er(OCC(CH_3)_3CHCOC(CH_3)_3)_3$].

12. The method of claim 1, wherein the bubbling step is performed until the molten reduced-sulfur alloy phase comprises less than about 0.00025 wt % S.

13. The method of claim 12, wherein the bubbling step is performed until the molten reduced-sulfur alloy phase comprises less than about 0.00010 wt % S.

14. The method of claim 1, wherein the gaseous desulfurizing compound includes a plurality of desulfurizing gases, each desulfurizing gas having a constituent element selected from the group: alkali metals, alkaline earth metals, and rare earth metals.

15. A method for casting an article, the method comprising:

heating a precursor compound comprising a metal organic complex (MOC) to decompose at least the MOC into a gaseous desulfurizing compound, the gaseous desulfurizing compound including a constituent element selected from a group consisting of: alkali metals, alkaline earth metals, and rare earth metals;

introducing the gaseous desulfurizing compound into a casting vessel containing a molten alloy;

bubbling the gaseous desulfurizing compound through the molten alloy to react at least the constituent element with sulfur contained in the molten alloy to form at least a portion of a solid sulfur-containing waste phase and a molten reduced-sulfur alloy phase;

separating the solid sulfur-containing waste phase and the molten reduced-sulfur alloy phase; and solidifying at least a portion of the reduced-sulfur alloy phase to form the cast article.

16. The method of claim 15, wherein the molten alloy is a nickel-based superalloy or a cobalt-based superalloy.

17. The method of claim 15, wherein the constituent element is at least one element selected from a group consisting of: Ca, Mg, Y, La, Er, and Ce.

18. The method of claim 17, wherein the at least one element includes Ca, and the precursor compound is selected from a group consisting of: calcium dipivaloylmethanate [$Ca(C_{11}H_{19}O_2)_2)$]; bis(hexafluoro-acetylacetonate) calcium (II), [$Ca(C_5HF_6O_2)_2)$]; bis(2,2-dimethyl-,6,6,7,7,8,8,8-heptafluoro-3,5-octanedione) calcium (II), [$Ca(C_{10}H_{10}F_7O_2)_2$]; bis(1,1,1-trifluoro-2,4-pentanedionato) calcium (II), [$Ca(F_3C(C{=}O)CH_2(C{=}O)CH_3)_2$]; and (1,1,1,5,5,5-hexafluoro-2,4-pentanedionato) calcium (II), [$Ca(F_3C(C{=}O)CH_2(C{=}O)CF_3)_2$]; and mixtures thereof.

19. The method of claim 17, wherein the at least one element includes Mg, and the precursor compound is selected from a group consisting of: magnesium dipivaloylmethanate [$Mg(C_{11}H_{19}O_2)_2)$]; bis(hexafluoro-acetylacetonate) magnesium (II), [$Mg(C_5HF_6O_2)_2)$]; bis(2,2-dimethyl-,6,6,7,7,8,8,8-heptafluoro-3,5-octanedione) magnesium (II), [$Mg(C_{10}H_{10}F_7O_2)_2$]; bis(1,1,1-trifluoro-2,4-pentanedionato) magnesium (II), [$Mg(F_3C(C{=}O)CH_2(C{=}O)CH_3)_2$]; and (1,1,1,5,5,5-hexafluoro-2,4-pentanedionato) magnesium (II), [$Mg(F_3C(C{=}O)CH_2(C{=}O)CF_3)_2$]; and mixtures thereof.

20. The method of claim 15, wherein the metal organic complex is a member of a family of tris(cyclopertadienyl) RE(III) compounds, where RE is a rare earth metal.

21. The method of claim 15, wherein the metal organic complex is a member of a family of tris[N,N-bis(trimethylsilyl)amide]RE(III) compounds, where RE is a rare earth metal.

22. The method of claim 15, wherein the metal organic complex is a member of a family of tris(2,2,6,6-tetramethyl-3,5-heptanedionate)RE(III) compounds, where RE is a rare earth metal.

* * * * *